US006115865A

United States Patent [19]

Fado

[11] Patent Number: 6,115,865

[45] Date of Patent: Sep. 12, 2000

[54] DEVICE FOR WASHING GOLF CLUBS

[76] Inventor: Joel Fado, 66 Fado Rd., Hillsdale, N.Y. 12529

[21] Appl. No.: 09/275,656

[22] Filed: Mar. 24, 1999

Related U.S. Application Data

[60] Provisional application No. 60/079,298, Mar. 25, 1998.

[51] Int. Cl.[7] ..... A46B 13/04; A63B 57/00

[52] U.S. Cl. ..... 15/21.1

[58] Field of Search ..... 15/21.1, 21.2

[56] References Cited

U.S. PATENT DOCUMENTS

| | | | |
|---|---|---|---|
| 3,332,099 | 7/1967 | Reiter | 15/21.1 |
| 3,619,841 | 11/1971 | Russell et al. | 15/21.1 |
| 4,180,884 | 1/1980 | Hess et al. | 15/21.1 |
| 4,676,839 | 6/1987 | Osborn | 15/21.1 X |
| 5,742,965 | 4/1998 | Leask | 15/21.1 |

FOREIGN PATENT DOCUMENTS

| | | | |
|---|---|---|---|
| 2066953 | 10/1993 | Canada | 15/21.2 |
| 2693377 | 1/1994 | France | 15/21.2 |

*Primary Examiner*—Mark Spisich
*Attorney, Agent, or Firm*—Robert M. Downey, P.A.

[57] ABSTRACT

A device for cleaning the heads of golf clubs includes a wash housing containing one or more motor driven brushes and a reservoir for containing a wash solution. Access ports are provided through a front wall of the wash housing to permit passage of the head of a wood, iron or putter therethrough so that the golf club head is positioned within the wash solution in the reservoir and in contact with the brushes. A control housing includes a currency receiving device, a control unit, and a change dispenser. Upon depositing a predetermined value of currency in the currency receiving device, the control unit activates an indicator light and a motor which moves the brushes within the wash housing throughout a timed wash cycle, thereby cleaning the golf club heads. At the expiration of the wash cycle, a timer alerts the control unit which deactivates the motor, thereby completing operation of the device.

3 Claims, 1 Drawing Sheet

DEVICE FOR WASHING GOLF CLUBS

This non-provisional application relates to provisional patent application No. 60/079,298 filed on Mar. 25, 1998, upon which a claim to priority under 35 U.S.C. §119(e) is based.

BACKGROUND OF THE INVENTION

1. Field of the Invention

The invention relates to a motorized golf club cleaning machine and, more particularly, to a golf club cleaning device including motor driven brushes housed with a cleaning chamber containing a reservoir of wash solution, and being operable through a timed cycle.

2. Discussion of the Related Art

During the play of a round of golf, a golfer's club heads, and particularly the club face and bottom of the club, become dirty. Periodically, it is necessary to clean the club heads of woods, irons and even putters to maintain a clean surface on the club face for striking a golf ball. It is further desirous to clean one's golf clubs in order to maintain their appearance and to preserve their useful life.

Typically, golf club heads are cleaned by first submerging them in a bucket of soapy water. Thereafter, the clubs are removed from the wash solution and the club head is rubbed with a towel or a sponge. It may also be necessary to use a stiff brush on the club face and bottom to remove dirt, caked mud, grass, sand, leaf particles, and other debris which becomes packed within grooves and other recessed areas. Because this process is labor intensive and time consuming, most golfers are reluctant to clean their clubs on a regular basis. And, while others have proposed devices for manually cleaning one's golf clubs, they still require considerable labor and time, thereby rendering them undesirable to most golfers.

Accordingly, there exists an urgent need in the golf industry for a device which is structured to automatically clean the heads of golf clubs, wherein the device includes motor driven brushes within a reservoir of cleaning solution enabling a golfer to simply insert the golf club head within the solution filled reservoir of the device so that the brushes provide aggressive scrubbing action about all surfaces of the club head to remove dirt, caked-on mud, sand, twigs, leaves and the like.

SUMMARY OF THE INVENTION

The present invention is directed to a device for cleaning the heads of golf clubs. The device includes a wash housing containing one or more motor driven brushes and a reservoir for containing a wash solution. Access ports are provided through a front wall of the wash housing to permit passage of the head of a wood, iron or putter therethrough so that the golf club head is positioned within the wash solution in the reservoir and in contact with the brushes. A control housing includes a currency receiving device, a control unit, and a change dispenser. Upon depositing a predetermined value of currency in the currency receiving device, the control unit activates an indicator light and a motor which moves the brushes within the wash housing in a scrubbing motion throughout a timed wash cycle, thereby cleaning the golf club heads. At the expiration of the wash cycle, measured by a timer in the control unit, the control unit deactivates the motor, thereby completing operation of the device.

With the foregoing in mind, it is a primary object of the present invention to provide a device for cleaning the heads of golf clubs in a highly efficient and effective manner requiring minimal labor.

It is still a further object of the present invention to provide a device for cleaning the heads of golf clubs which is simple to operate.

It is still a further object of the present invention to provide a device for cleaning the heads of golf clubs which requires minimal maintenance by a person without special training or skill and without the need for tools.

It is a further object of the present invention to provide a portable device for cleaning the heads of golf clubs, which is transportable using a standard hand truck, and yet sturdy and heavy enough to make it difficult for unauthorized personnel or customers to move the device from its installed location.

It is still a further object of the present invention to provide a device for cleaning the heads of golf clubs which includes locking mechanisms to prevent unauthorized removal of the device, as well as unauthorized access to the interior of the device.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
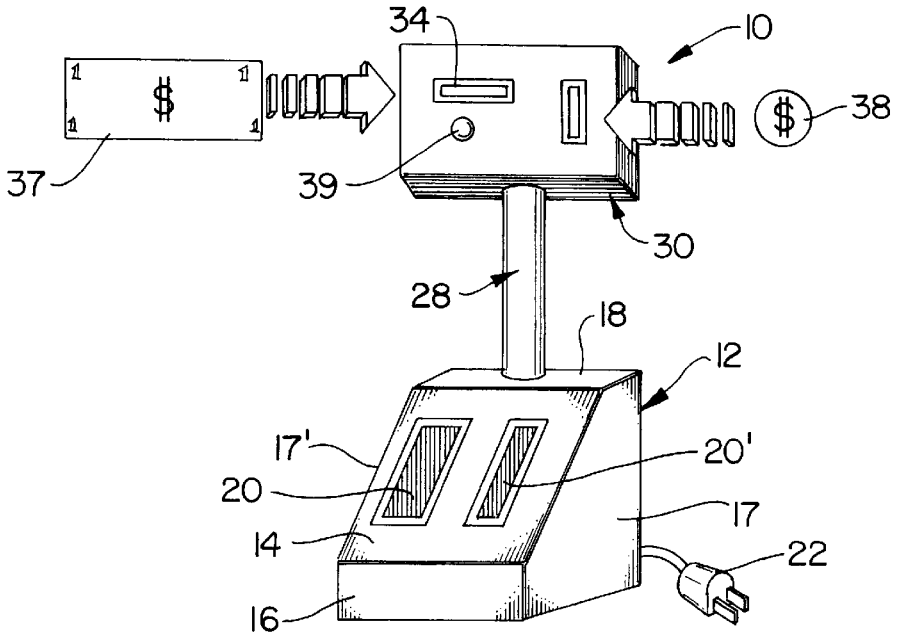
FIG. 1 is a front perspective view of the golf club head cleaning device of the present invention.
Figure 2:
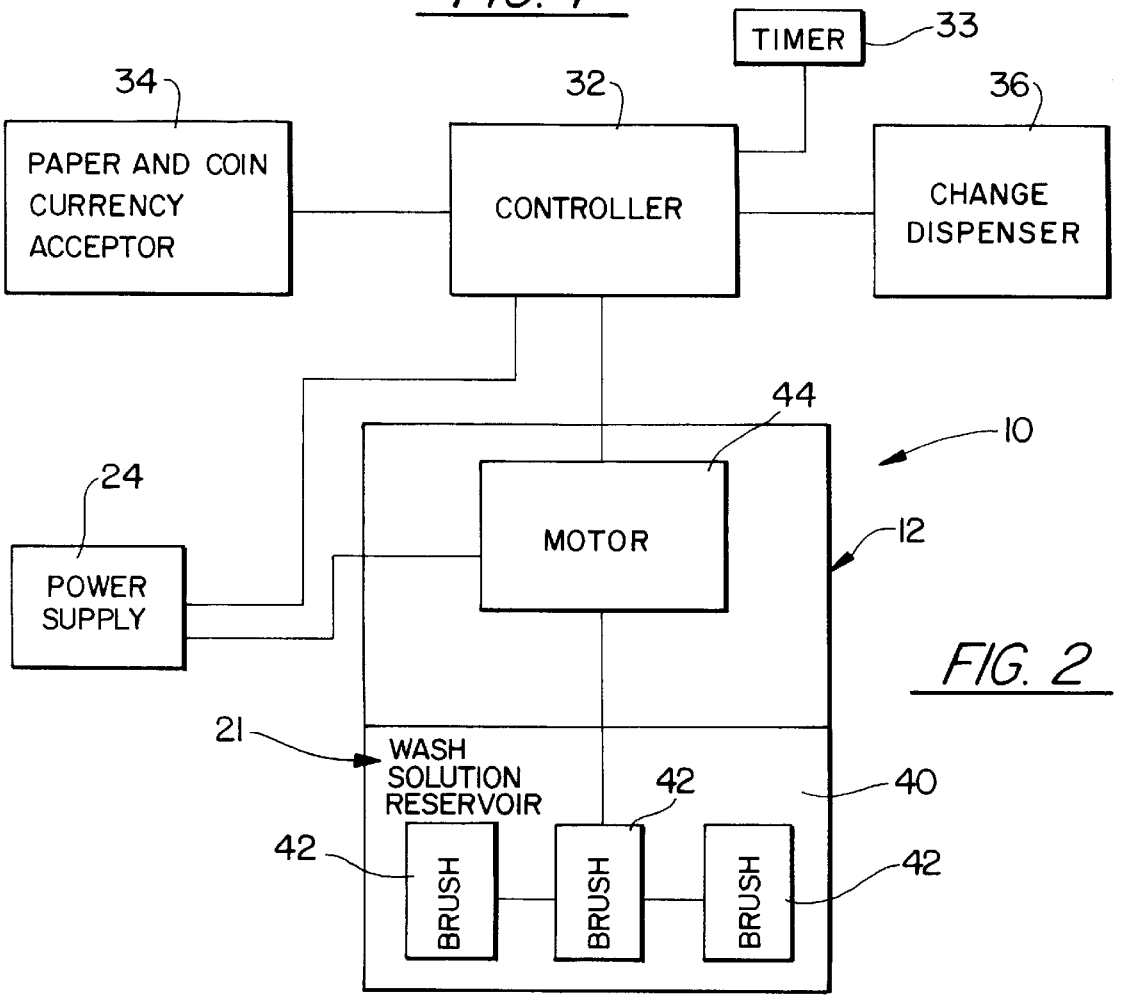
FIG. 2 is a schematic diagram of the golf club head cleaning device, showing the functional interrelation of the principal components thereof.

Referring to FIGS. 1 and 2, the present invention is directed to a device for cleaning golf club heads and is generally indicated as 10. The device 10 includes a lower housing structure defining a wash housing 12, and including a front wall assembly having an upper front wall portion 14 and a lower front wall portion 16. In a preferred embodiment, the upper front wall portion 14 is disposed at an upwardly sloped angle from the lower front wall portion 16 to a top wall 18. The housing further includes opposite side walls 17, 17', a bottom and back wall (not shown in the drawings).

The upper front wall portion 14 is provided with one or more access ports 20, 20' to accommodate passage of a golf club head therethrough and into an interior wash chamber 21 of the housing 12. For instance, the device 10, shown in FIG. 1, includes a first access port 20 which is sized and configured to accommodate passage of a wood club head and a second access port 20' sized and configured for passage of an iron club head or a putter head. The access ports 20, 20' may be provided with flexible shields, such as a rubber panel with an elongate, vertical slot, or opposing bristles, to prevent wash solution from splashing through the access ports 20, 20' during operation of the device 10. The access ports 20, 20' may further be provided with guard means for preventing accidental contact with the moving components within the housing.

A vertical support post 28 extends upwardly from the lower wash housing 12 to support a control housing 30 in spaced relation above the lower housing 12 and preferably at a height to provide easy access to a user without having to bend over. The control housing 30 contains several components including a controller 32, a paper and coin currency acceptor 34, and a change dispenser 36. The controller 32 may be a CPU, such as a circuit control board or mother board. The currency acceptor 34 and change dispenser 36 communicate with the controller 32 to calculate amounts of currency deposited (inserted) and amounts owed as change. Upon depositing a predetermined value of currency in bills 37 and/or coins 38 through the paper and coin accepting slots on the control housing 30 for acceptance through the paper and coin currency acceptor 34, the controller 32 activates an electric motor 44. Amounts of currency deposited which are in excess of the predetermined value required to activate the device are refunded to the user at the change dispenser 36. The controller 32 controls the change dispenser and communicates the amount of change owed.

In the preferred embodiment, the electric motor 44 is contained within the lower housing 12 above a wash solution reservoir 40. The wash solution reservoir 40 is in the lower portion of the housing 12 interior and is adapted to contain a predetermined quantity of wash solution or cleaning solvent. Drain means may be provided on the bottom or back of the housing 12 to facilitate draining of the wash solution as necessary. Once dirty wash solution is drained from the reservoir 40, clean wash solution may be replaced through the access ports 20, 20' or through a fill opening, preferably provided on the top wall 18.

One or more brushes 42 are positioned and disposed within the wash solution reservoir 40 and are drivingly interconnected to the motor 44. Upon activation of the motor 44 by controller 32, the brushes 42 are drivingly rotated or moved to provide a scrubbing action. A timer 33 controls a pre-set wash cycle. During the wash cycle, an indicator light 39 on the control housing 30 is illuminated. At the end of the wash cycle, timer 33 communicates with controller 32 to deactivate the motor 44, thereby stopping the brushes 42. An electric cord 22 plugs into a conventional power supply source 24 to provide power to the components of the device 10.

In a preferred embodiment, the wash solution reservoir is capable of holding a sufficient charge of cleaning solution for a minimum of six hours of operation time to clean moderately soiled clubs. The wash solution reservoir 40 may further be provided with recirculating means for circulating dirty wash solution through a removable and serviceable filter, thus extending the useful life of the cleaning solution.

In another embodiment, the wash solution reservoir may be connected to a clean water supply and waste water system including a separate, easily serviceable solvent holding tank and mixing device.

In use, the club head of a golf club is inserted through the appropriate access port 20, 20' so that the club head is immersed in the wash solution reservoir and in contact with the brushes 42. Activation of the brushes creates an aggressive scrubbing action along the typically horizontal grooves found on most club head faces. A similar aggressive scrubbing action is applied to the bottom of the club and, possibly, the sides of the club. However, it is important that the highly polished surfaces of woods be protected from abrasive action to prevent scratching and/or damage to the polished surfaces. Accordingly, the brushes 42 should be specifically shaped, configured and positioned so that they contact the club head face and bottom when the golf club head is properly inserted into the wash housing 12. Further, separate cleaning stations may be required, one for irons which are inherently resistant to scratching and having typically smaller head dimensions parallel to the face, and a different cleaning station for woods which are easily scratched and typically much wider in the damage parallel to the face. Accordingly, it may be preferable to configure the brushes 42 for either woods or irons, wherein the specific brush configuration would be installed for the appropriate cleaning station.

While the instant invention has been shown and described in accordance with a practical and preferred embodiment thereof, it is recognized that departures from the instant disclosure within the spirit and scope of the following claims as interpreted under the doctrine of equivalents.

Now that the invention has been described,

What is claimed is:

1. A device for cleaning the heads of golf clubs with a wash solution, said device comprising:

a wash housing having an interior wash chamber surrounded by a wall structure and including a reservoir therein for containing a charge of the wash solution;

brush means within said wash chamber and exposed to the wash solution in said reservoir for scrubbing the golf club heads and including a plurality of brushes positioned and disposed for engaging the exterior surfaces of the club heads when the club heads are placed within said interior wash chamber and said plurality of brushes being at least partially immersed in the wash solution;

motor means for moving said brushes in a scrubbing motion against the club heads;

control means for activating and deactivating said motor means;

currency receiving means for receiving payment of money, said currency receiving means communicating with said control means, wherein said control means activates said motor means upon said currency receiving means having received a predetermined value of currency;

timer means communicating with said control means for deactivating said motor means after a predetermined period of time, thereby defining a wash cycle;

a control housing supported in spaced relation above said wash housing and being structured and disposed for protectively housing said control means, said timer means and said currency receiving means; and access means for facilitating placement of the club heads within said interior wash chamber so that the club heads are positioned and disposed in contact with said brush means and the wash solution.

2. The device as recited in claim 1 wherein said access means includes a plurality of ports formed through said wall structure of said wash housing, said ports being specifically sized and configured to permit passage of particular types of club heads therethrough, including woods, irons and putters.

3. The device as recited in claim 1 further including change dispensing means communicating with said control means for dispensing change for currency received by said currency receiving means which is in excess of said predetermined value of currency required to activate said motor means.

* * * * *